US006043010A

United States Patent [19]

Hokazono et al.

[11] Patent Number: 6,043,010

[45] Date of Patent: Mar. 28, 2000

[54] SILVER HALIDE PHOTOGRAPHIC MATERIAL

[75] Inventors: Hirohisa Hokazono; Tomokazu Yasuda; Kentaro Shiratsuchi; Takashi Ozawa, all of Kanagawa, Japan

[73] Assignee: Fuji Photo Film Co., Ltd., Minami-Ashigara, Japan

[21] Appl. No.: 09/040,383

[22] Filed: Mar. 18, 1998

[30] Foreign Application Priority Data

Mar. 24, 1997 [JP] Japan ..... 9-069814

[51] Int. Cl.[7] ..... G03C 3/00; G03C 1/76

[52] U.S. Cl. ..... 430/501; 430/536; 430/537; 430/950; 430/961

[58] Field of Search ..... 430/536, 537, 430/950, 961, 527, 533, 534, 535, 501

[56] References Cited

U.S. PATENT DOCUMENTS

| | | | |
|---|---|---|---|
| 4,203,716 | 5/1980 | Chen et al. | 430/222 |
| 4,822,727 | 4/1989 | Ishigaki et al. | 430/537 |
| 5,478,710 | 12/1995 | Muller et al. | 430/537 |
| 5,738,983 | 4/1998 | Smith et al. | 430/537 |
| 5,756,273 | 5/1998 | Wang et al. | 430/961 |
| 5,770,353 | 6/1998 | Wang et al. | 430/537 |
| 5,849,472 | 12/1998 | Wang et al. | 430/537 |
| 5,866,312 | 2/1999 | Wang et al. | 430/537 |

FOREIGN PATENT DOCUMENTS 201950 8/1996 Japan .

*Primary Examiner*—Richard L. Schilling
*Attorney, Agent, or Firm*—Burns, Doane, Swecker & Mathis, LLP

[57] ABSTRACT

An object of the present invention is to provide a silver halide photographic material having improved antiblocking property without deterioration of film brittleness and image quality due to addition of a polymer latex.

A silver halide photographic material having at least one silver halide emulsion layer and at least one nonsensitive protective layer on a support, in which the nonsensitive protective layer contains polymer grains represented by the following General Formula (1) in a proportion by weight of 5 to 300% to a hydrophilic colloid as a binder, and the polymer grains have a mean grain diameter of at most 0.1 μm, $$—(A)_x—(B)_y—(C)_z— \qquad \text{General Formula (1)}$$

wherein A is a repeated unit derived from an ethylenically unsaturated monomer containing carboxyl group, B is a repeated unit derived from a cross-linking monomer having at least two ethylenically unsaturated groups and C is a repeated unit derived from another ethylenically unsaturated monomer than those of A and B, x, y and z are copolymerization ratios, x being 1 to 50 weight %, y being 0 to 20 weight % and z being 30 to 85 weight %, and x+y+z=100.

8 Claims, No Drawings

SILVER HALIDE PHOTOGRAPHIC MATERIAL

BACKGROUND OF THE INVENTION

1. Field of the Invention

This invention relates to a silver halide photographic material having improved antiblocking property and film brittleness.

2. Description of the Prior Art

It is known that when a silver halide photographic material is stored at a high temperature and high humidity, in general, blocking trouble tends to occur between the surface of the light-sensitive material and the back surface. In order to prevent the blocking trouble, matting (roughening) of the surface has widely been carried out by incorporating organic or inorganic fine grains (so-called matting agent) in an emulsion layer of a photographic material or a surface-protective layer on a backing surface. The matting agent can have various sizes depending on the purpose thereof, but one having a range of 10 to 10 μm in size is preferably used.

Since the matting agent generally contains a number of large sized grains exceeding 1 μm, however, light-scattering is so much that in the case of color photographic materials, in particular, deterioration of the surface lustre, haze and graininess is caused and the amount of the matting agent to be used is thus limited.

Accordingly, another antiblocking technique has hitherto been known comprising adding colloidal silica or polymer latex each having a smaller grain size (i.e. submicron grain diameter) than the matting agent to a protective layer or emulsion layer jointly with the matting agent, as disclosed in, for example, Japanese Patent Laid-Open Publication No. 100226/1978 in which colloidal silica is added to a protective layer. In this case, however, there arises a problem that the film brittleness is worsened.

As a technique of adding a polymer latex, there are proposed further patents, for example, EP 751,422 in which a polymer latex having a glass transition temperature of at least 70° C. is added to a protective layer and Japanese Patent Laid-Open Publication No. 251844/1986, in which a polymer latex having a glass transition temperature of at least 20° C. and another polymer latex having a glass transition temperature of lower than 20° C. are jointly used. According to these techniques, however, improvement of the film brittleness is not sufficient and the haze, surface lustre, etc. are somewhat deteriorated.

Many of the problems resulting from adding the fine grains are due to lacking in the affinity of the grain surfaces and hydrophilic colloid layer and the effect of the polymer latexes described in these two patents is not sufficient in spite of that a monomer having a hydrophilic functional group such as carboxylic group is incorporated in the polymer latex so as to increase the affinity with the hydrophilic colloid layer.

Japanese Patent Laid-Open Publication No. 134336/1993 discloses a technique comprising adding a polymer latex having a very large content, i.e. 5 to 100 mol % of carboxylic groups to a protective layer, but in this case, there arises a problem that the polymer latex tends to be dissolved in a processing solution due to be rendered excessively hydrophilic. When the grain diameter is further rendered smaller to improve the image quality, the grain surface area is too large to solve the problem of the dissolution.

Japanese Patent Laid-Open Publication No. 201950/1996 discloses a technique comprising adding a polymer latex having hydrophilic groups and being bridged to a protective layer, whereby dissolution in a processing solution can be prevented. However, the polymer latexes described therein are all soft (exhibiting a glass transition temperature of at most about 40° C.) or rendering hydrophilic is insufficient so that improvement of the antiblocking effect is not achieved and the image quality is not good.

Japanese Patent Laid-Open Publication No. 138572/1994 also discloses a technique comprising adding a polymer latex having hydrophilic groups and being bridged to a protective layer, but this technical content is limited to a matting agent having a grain diameter of at least 2 μm, thus raising a problem on deterioration of the image quality such as graininess.

SUMMARY OF THE INVENTION

It is an object of the present invention to provide a silver halide photographic material having improved antiblocking property without deterioration of film brittleness and image quality due to addition of a polymer latex.

This object can be attained by the following inventions and embodiments.

(1) A silver halide photographic material having at least one silver halide emulsion layer and at least one nonsensitive protective layer on a support, in which the nonsensitive protective layer contains polymer grains represented by the following General Formula (1) in a proportion by weight of 5 to 300% to a hydrophilic colloid as a binder, and the polymer grains have a mean grain diameter of at most 0.1 μm, $$-(A)_x-(B)_y-(C)_z- \qquad \text{General Formula (1)}$$

wherein A is a repeated unit derived from an ethylenically unsaturated monomer containing carboxyl group, B is a repeated unit derived from a cross-linking monomer having at least two ethylenically unsaturated groups and C is a repeated unit derived from another ethylenically unsaturated monomer than those of A and B, x, y and z are copolymerization ratios, x being 1 to 50 weight %, y being 0 to 20 weight % and z being 30 to 85 weight %, and x+y+z=100.

(2) The silver halide photographic material as described in the above described (1), wherein in General Formula (1), x is 15 to 50 weight %, y is 1 to 20 weight %, z is 30 to 85 weight % and x+y+z=100.

(3) The silver halide photographic material as described in the above described (1), wherein the polymer represented by General Formula (1) has a glass transition temperature of at least 70° C.

(4) The silver halide photographic material as described in the above described (1), wherein the polymer grains have a mean grain diameter of 0.01 μm to 0.08 μm.

(5) The silver halide photographic material as described in the above described (1), wherein the polymer grains have a mean grain diameter of 0.005 μm to 0.05 μm.

(6) The silver halide color photographic material as described in the above described (1), wherein the silver halide photographic material is a color photographic material.

(7) The silver halide color photographic material as described in the above described (1), wherein the photographic material is in the form of a roll wrapped in a spool with an outer diameter of 5 to 11 mm.

(8) The silver halide color photographic material as described in the above described (1), wherein the support contains at least 30 weight % of a polyester consisting predominantly of naphthalenedicarboxylic acid and ethylene glycol.

(9) The silver halide color photographic material as described in the above described (1), wherein the silver halide photographic material has a value of diffusion rms granularity of Visual Density measured by the use of a diffusion light source in a density region capable of giving the minimum density +1.0 of at most 11.

(10) The silver halide color photographic material as described in the above described (1), wherein the nonsensitive protective layer is provided above the silver halide emulsion layer and contains non-soluble matting agent grains with a grain size of at least 2 $\mu$m in a proportion of at most 0.008 g/m$^2$.

DETAILED DESCRIPTION OF THE INVENTION

The inventors have made various efforts to develop a silver halide photographic material having improved anti-blocking property without deterioration of film brittleness and image quality and consequently, have found that use of the specified polymer grains for a nonsensitive protective layer is effective for this purpose. The present invention is based on this finding.

Accordingly, the present invention provides a silver halide photographic material having at least one silver halide emulsion layer and at least one nonsensitive protective layer on a support, in which the nonsensitive protective layer contains polymer grains represented by the following General Formula (1) in a proportion by weight of 5 to 300% to a hydrophilic colloid as a binder, and the polymer grains have a mean grain diameter of at most 0.1 $\mu$m, $$-(A)_x-(B)_y-(C)_z- \qquad \text{General Formula (1)}$$

wherein A is a repeated unit derived from an ethylenically unsaturated monomer containing carboxyl group, B is a repeated unit derived from a cross-linking monomer having at least two ethylenically unsaturated groups and C is a repeated unit derived from another ethylenically unsaturated monomer than those of A and B, x, y and z are copolymerization ratios, x being 1 to 50 weight %, y being 0 to 20 weight % and z being 30 to 85 weight %, and x+y+z=100.

Examples of the monomer capable of giving the repeated unit represented by A in the above described General Formula (1) are acrylic acid, methacrylic acid, itaconic acid, maleic acid, fumaric acid, citraconic acid, styrenecarboxylic acid, 2-carboxyethyl acrylate, etc. The present invention is not intended to be limited thereby. These monomers can be used individually or in combination. Above all, acrylic acid and methacrylic acid are particularly preferred.

Examples of the monomer capable of giving the repeated unit represented by B in the above described General Formula (1) are divinylbenzene, 4,4'-isopropylidenediphenylene diacrylate, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene glycol diacrylate, ethylene glycol dimethacrylate, ethylidene diacrylate, ethylidene dimethacrylate, 1,6-diacrylamidohexane, N,N'-methylenebisacryl amide, N,N'-(1,2-dihydroxy) ethylenebisacrylamide, 2,2'-dimethyl-1,3-trimethylene dimethacrylate, phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetraacrylate, triethylene glycol dimethacrylate, 1,3,5-triacryloylhexanehydro-s-triazine, bisacrylamidoacetic acid, ethylidyne trimethacrylates, propylidyne triacrylate, vinylallyl oxyacetate, etc. The present invention is not intended to be limited thereby. These monomers can be used individually or in combination. Above all, ethylene glycol dimethacrylate, divinylbenzene and N,N'-methylenebisacrylamide are preferable and ethylene glycol dimethacrylate is more preferably used.

Examples of the monomer capable of giving the repeated unit represented by C in the above described General Formula (1) are acrylic acid esters such as methyl acrylate, ethyl acrylate, cyclohexyl acrylate, benzyl acrylate, phenyl acrylate, etc., methacrylic acid esters such as methyl methacrylate, ethyl methacrylate, n-butyl methacrylate, isobutyl methacrylate, t-butyl mathacrylate, cyclohexyl methacrylate, phenyl methacrylate, benzyl methacrylate, etc., styrenes such as styrene, o-methylstyrene, m-methylstyrene, p-methylstyrene, $\alpha$-methylstyrene, p-tert-butylstyrene, p-chlorostyrene, etc., vinyl halides such as vilidene chloride, etc. The present invention is not intended to be limited thereby. These monomers can be used individually or in combination. Above all, methyl methacrylate, t-butyl methacrylate and styrene are preferable and methyl methacrylate is more preferably used.

Preferably, choice of the monomers constituting the repeated units represented by the above described A to C can optionally be carried out depending on setting up of the glass transition temperature of the copolymer grains. The setting up of the glass transition temperature of the copolymers can be carried out by the following calculation method. Namely, an expected value of the glass transition temperature of each copolymer can be calculated from the sum of values obtained by multiplying a value of the glass transition temperature of a homopolymer of each copolymer component by the weight fraction of each copolymer component. The glass transition temperature of the polymer grains can be determined by the differential scanning calorimetery method (DSC).

In the above described General Formula (1), x is preferably 15 to 50 weight %, more preferably 15 to 30 weight %. y is preferably 1 to 20 weight %, more preferably 3 to 15 weight %. z is preferably 30 to 85 weight %, more preferably 60 to 80 weight %.

Compounds of the polymer grains represented by General Formula (1), preferably used in the present invention, are given in the following without limiting the same. In this formula, the monomer fraction is represented by weight %.

TABLE 1

Examples of Compounds

| | $(A)_x$ | $(B)_y$ | $(C)_z$ | Average Grain Diameter (nm) | Tg (° C.) |
|---|---|---|---|---|---|
| P-1 | MA (20) | EGDM (10) | MMA (70) | 41 | 130 |
| P-2 | AA (20) | EGDM (10) | MMA (70) | 45 | 106 |
| P-3 | MA (20) | DVB (5) | MMA (75) | 45 | 134 |
| P-4 | MA (30) | DVB (5) | ST (65) | 49 | 143 |
| P-5 | MA (50) | DVB (5) | MMA (35), n-BMA (10) | 63 | 150 |
| P-6 | CEA (15) | EGDM (5) | MMA (80) | 50 | 85 |
| P-7 | MA (30) | EGDM (10) | MMA (60) | 42 | 142 |
| P-8 | MA (40) | EGDM (10) | MMA (50) | 44 | 150 |
| P-9 | MA (30) | EGDM (10) | n-BMA (60) | 50 | 88 |
| P-10 | MA (15) + AA (15) | EGDM (10) | MMA (60) | 46 | 125 |
| P-11 | MA (20) | MBAA (5) | MMA (75) | 60 | 132 |
| P-12 | MA (20) + IA (5) | EGDM (10) | MMA (65) | 56 | 128 |

(Note)
MA: methacrylic acid
EGDM: ethylene glycol dimethacrylate
MMA: methyl methacrylate
AA: acrylic acid
DVB: divinylbenzene;
ST: styrene
n-BMA: n-butyl methacrylate
CEA: 2-carboxyethyl acrylate
MBAA: methylenebisacrylamide;
IA: itaconic acid The above described polymers can be obtained by general emulsion polymerization methods. The general emulsion polymerization methods are illustrated in detail in Soichi Muroi: "Chemistry of High Molecular Latexes", published by Kobunshi Kankokai (1970).

The polymer grains used in the present invention can be obtained, for example, by subjecting 5 to 40 weight % of a monomer mixture in water as a dispersing medium in the presence of 0.05 to 5 weight % of a polymerization initiator and 0.1 to 20 weight % of a dispersing agent, based on the monomer, to polymerization at 30 to 100° C., preferably 60 to 90° C. for 3 to 8 hours while stirring the mixture. The concentration of the monomer, the amounts of the initiator and dispersing agent, the reaction temperature and the time can suitably be adjusted considering the aimed average grain diameter, etc.

As the initiator, there can for example be used inorganic peroxide compounds such as potassium persulfate, ammonium persulfate, etc., azo nitrile compounds such as sodium salt of azobiscyanovaleric acid, azoamidine compounds such as 2,2'-azobis(2-methylpropionamide) hydrochloride, etc., cyclic azoamidine compounds such as 2,2'-azobis[2-(5-methyl-2-imidazoline-2-yl)propane] hydrochloride etc., azoamide compounds such as 2,2'-azobis {2-methyl-N-[1, 1'-bis(hydroxymethyl)-2-hydroxyethyl]propionamide}, etc. In particular, potassium persulfate and ammonium persulfate are more preferably used.

As the dispersing agent, for example, there can be used anionic surfactants and nonionic surfactants and the former is more preferable.

Synthetic examples of the polymer grains of the present invention will now be given.

Synthetic Example

Synthesis of P-1

450 ml of distilled water and 2.5 g of sodium dodecylsulfate were respectively added to a three neck glass flask of 500 ml, equipped with a stirrer, thermometer and reflux condenser, and stirred. The mixture was heated to 70° C. in nitrogen stream. 1 g of potassium persulfate was then added thereto, after which 35 g of methyl methacrylate, 10 g of methacrylic acid and 5 g of ethylene glycol dimethacrylate were mixed to give a monomer composition and simultaneously added thereto, followed by heating and stirring at 70° C. for 6 hours as it was to complete the emulsion polymerization.

The mixture was cooled to room temperature and then filtered to obtain 506 g of a fine grain dispersion having a solid content of 10.4 weight %, average grain diameter of 41 nm and variation coefficient of 21% (yield: 98%).

In addition to the above described synthetic example, other polymer grains P-2 to P-12 were synthesized in the similar manner.

Furthermore, comparative polymer grains Q-1 to Q-6 consisting of compounds shown in the following Table 2 were synthesized in the similar manner.

TABLE 2

Examples of Comparative Compounds

| | $(A)_x$ | $(B)_y$ | $(C)_z$ | Average Grain Diameter (nm) | Tg (° C.) |
|---|---|---|---|---|---|
| Q-1 | MA (3) (EP 751422) | — | MMA (97) | 70 | 110 |
| Q-2 | MA (20) | — | MMA (80) | 48 | 130 |
| Q-3 | MA (30) | — | ST (70) | 49 | 135 |
| Q-4 | — | EGDM (10) | MMA (90) | 50 | 111 |
| Q-5 | MA (20) | EGDM (10) | MMA (70) | 121 | 130 |
| Q-6 | AA (25) | EGDM (10) | EA (65) | 49 | 20 |

(Note)
EA: ethyl acrylate

The polymer grains used in the present invention have an average grain diameter of at most 0.1 μm, preferably at most 0.05 μm. When a polymer latex having a markedly larger mean grain diameter is added, the antiblocking property is advantageous, but transparency of an added layer is markedly lowered to deteriorate properties as a photographic material. The polymer grains should have a glass transition temperature of at least 70° C., particularly preferably at least 85° C. If the glass transition temperature is lower than 70° C., brittleness is advantageous, but the film is too soft to reveal the antiblocking property. An addition quantity of the polymer latex should be 5 to 300%, preferably 10 to 100%, more preferably 20 to 50% per weight of a hydrophilic colloid of a layer to be added. If the addition quantity is too small, the antiblocking property is not revealed and if too large, the brittleness of the added layer is deteriorated or the transparency is deteriorated.

A nonsensitive protective layer to which the polymer grains of the present invention are to be added can be at the side of a light-sensitive silver halide emulsion layer, at the opposite side to the light-sensitive silver halide emulsion layer, i.e. at the side of a backing layer or at both the sides of the light-sensitive silver halide emulsion layer and the backing layer. The polymer grains of the present invention can be added to one or more of a plurality of nonsensitive protective layers.

A nonsensitive protective layer to which the polymer grains of the present invention are to be added can be provided preferably above a light-sensitive emulsion layer or more preferably as the outermost layer.

When using the polymer grains of the present invention for a light-sensitive material, in particular, having a low granulairty, i.e. diffusion granularity of at most 11, the effects are remarkable. A sensitive material to be subjected to reading through a scanner or to direct projecting, because of a small emulsion size, is largely affected by the granularity. When using the polymer grains of the present invention, the amount of a matting agent is decreased and the surface roughness after processing is decreased, whereby there can be obtained a light-sensitive material with a good image quality and improved antistocking property, film strength, graininess amd film brittleness, the present invention aims.

The granularity is a value of diffusion rms granularity of Visual Density measured by the use of a diffusion light source in a density region capable of giving the minimum density +1.0 (rms value multiplied by 1000, obtained through a circular measurement aperture with a diameter of 48 μm by the method described in ANSI PH 2.40—1985).

As a hydrophilic colloidal binder used in the nonsensitive protective layer of the present invention, it is preferable to use gelatin, but other hydrophilic colloids can be used, for example, proteins such as gelatin derivatives, graft polymers of gelatin and other polymers, albumin, casein, etc.; cellulose derivatives such as hydroxyethyl cellulose, carboxymethyl cellulose, cellulose sulfuric acid esters, etc., saccharide derivatives such as sodium alginates, starch derivatives, etc.; and synthetic hydrophilic high molecular materials such as homo- or copolymers of polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As the gelatin, there can also be used lime-treated gelatins, acid-treated gelatins, acid-treated gelatins as disclosed in "Bull. Soc. Sci. Phot. Japan" No. 16, page 30 (1966) and hydrolyzates or enzyme decomposition products of gelatin.

The nonsensitive protective layer of the present invention can include, in addition to the foregoing hydrophilic colloid binders (e.g. gelatin) and polymer latexes, surfactants, antistatic agents, matting agents, lubricants, colloidal silica, gelatin plasticizers, etc.

As the matting agent, there is preferably used non-soluble matting agent grains with a grain size of at least 2 μm, for example, polymethylmethacrylate, polystyrene, acrylic acid-methylmethacrylate copolymers, methacrylic acid-methylmethacrylate copolymers, etc. This matting agent is generally added to a nonsensitive hydrophilic colloid upper layer in a proportion of at most 0.008 g/m$^2$.

The silver halide photographic material of the present invention can sufficiently comprise, on a support, at least one silver halide emulsion layer and at least one nonsensitive hydrophilic colloid layer and the polymer grains of the present invention can be applied to any one of black and white sensitive materials (in particular, light-sensitive materials for reproduction or for X-ray) and color sensitve materials. The advantages of the present invention can also be revealed when the silver halide photographic material of the present invention is applied to films with lens units.

In the present invention, a silver halide photographic material having a transparent magnetic recording layer can effectively be used.

The silver halide photographic material having a magnetic recording layer can be formed of a previously heat-treated polyester thin support described in detail in Japanese Patent Laid-Open Publication Nos. 35118/1994 and 17528/1994 and Hatsumei Kyokai Technical Report No. 6023/94, for example, a support of polyethylene aromatic dicarboxylate type polyester having a thickness of 50 to 300 μm, preferably 50 to 200 μm, more preferably 80 to 115 μm, most preferably 85 to 105 μm, subjected to a heat treatment (annealing) at a temperature of at least 40° C. and of lower than the glass transition temperature for 1 to 1500 hours, to a surface treatment, for example, by ultraviolet irradiation as described in Japanese Patent Publication Nos. 2603/1968, 2604/1968 and 3828/1970, by corona discharge as described in Japanese Patent Publication Nos. 5043/1973 and 131576/1976 or glow discharge as described in Japanese Patent Publication Nos. 7578/1960 and 43480/1971, to undercoating as described in U.S. Pat. No. 5,326,689 or optionally to providing with a bottom layer as described in U.S. Pat. No. 2,761,791 and then to coating of ferromagnetic grains as described in Japanese Patent Laid-Open Publication Nos. 23505/1984, 195726/1992 and 59357/1994. The above described layer can be formed in the form of a stripe as described in Japanese Patent Laid-Open Publication Nos. 124642/1992 and 124645/1992.

As occasion demands, an antistatic treatment as described in Japanese Patent Laid-Open Publication No. 62543/1992 is carried out and finally, a silver halide photographic emulsion is coated, which is described in Japanese Patent Laid-Open Publication Nos. 166932/1992, 41436/1991 and 41437/1991.

The thus prepared sensitive material is preferably subjected to control and recording of production data by methods described in Japanese Patent Publication Nos. 86817/1992 and 87146/1994, before or after which the sensitive material is cut in a film with a narrower width than 135 size of the prior art and subjected to perforation of one side-two holes per format image so as to be matched with a smaller format image than in the prior art, according to a method described in Japanese Patent Laid-Open Publication No. 125560/1992.

For application, the thus resulting film is charged in a cartridge package of Japanese Patent Laid-Open Publication No. 157459/1992, a cartridge described in FIG. 9 of Example in Japanese Patent Laid-Open Publication No. 210202/1993, a film cartridge of U.S. Pat. No. 4,221,479 or a cartridge described in U.S. Pat. Nos. 4,834,308, 4,834,366, 5,226,613 and 4,846,418.

A film cartridge to be used herein is preferably of such a type that a tongue can be received as disclosed in U.S. Pat. Nos. 4,848,893 and 5,317,355, in view of light shielding properties.

Furthermore, it is favorable to use a cartridge having a rocking mechanism as disclosed in U.S. Pat. No. 5,296,886, a cartridge capable of indicating used states as disclosed in U.S. Pat. No. 5,347,334 and a cartridge having a function of inhibiting double exposures. A cartridge capable of readily receiving a film by only putting it therein can also be used, as disclosed in Japanese Patent Laid-Open Publication No. 85128/1994.

The thus prepared film cartridge can be subjected to various photographing and developing processings using cameras, developing equipments, laboratory equipments, etc., illustrated below.

For example, the functions of the film cartridge can sufficiently be obtained when using cameras of simple loading type described in Japanese Patent Laid-Open Publication Nos. 8886/1994 and 99908/1994, auto-winding color image cameras described in Japanese Patent Laid-Open Publication Nos. 57398/1994 and 101135/1994, cameras each capable of exchanging a film during photogrphing described in Japanese Patent Laid-Open Publication No. 205690/1994, cameras capable of subjecting photographing information, for example, panoramic shots, high vision size shots and ordinary photographing (capable of magnetic recording to choose a print aspect ratio) to magnetic recording, described in Japanese Patent Laid-Open Publication Nos. 293138/1993 and 283382/1993, cameras each having a function of inhibiting double exposures as disclosed in Japanese PatentLaid-Open Publication No. 101194/1994 and cameras capable of indicating used sates as disclosed in Japanese Patent Laid-Open Publication No. 150577/1993.

The film photographed in this way can be processed by an automatic processor as disclosed in Japanese Patent Laid-Open Publication Nos. 222514/1994 and 222545/1994, by utilizing magnetic recording on the film as described in Japanese Patent Laid-Open Publication Nos. 95265/1994 and 123054/1992, or by utilizing, before, during or after processing, a function of choosing an aspect ratio as disclosed in Japanese Patent Laid-Open Publication No. 19364/1993.

In the case of cinefilm processing during developing, the film is processed by splicing, as disclosed in Japanese Patent Laid-Open Publication No. 119461/1993.

During or after develpment, an attachment or detachment processing can be carried out as disclosed in Japanese Patent Laid-Open Publication No. 148805/1994.

After thus processing, film information can be converted into prints through back printing or front printing on color papers by methods described in Japanese Patent Laid-Open Publication Nos. 184835/1990, 186335/1992 and 79968/1994, and can be returned to customers with index prints and returnable cartridges as disclosed in Japanese Patent Laid-Open Publication Nos. 11353/1993 and 232594/1993.

Known photographic additives which can be used in color photographic materials according to the present invention are to be incorporated in this specification by reference to the following three Research Disclosures, with related pages:

| Additives | RD 17643 (page) | RD 18716 (page) | RD 307105 (page) |
|---|---|---|---|
| 1. Chemical Sensitizer | 23 | 648, right col. | 866 |
| 2. Sensitivity Improver | | 648, right col. | |
| 3. Spectral Sensitizer, Supersensitizer | 23–24 | 648, right col.–649, right col. | 866–868 |
| 4. Whitening Agent | 24 | 647, right col. | 868 |
| 5. Antifoggant, Stabilizer | 24–25 | 649, right col. | 868–870 |
| 6. Light-absorber, Filter, Dye, UV Absorber | 25–26 | 649, right col.–650, left col. | 873 |
| 7. Stain Inhibitor | 25, right col. | 650, left col.–right col. | 872 |
| 8. Dye Image Stabilizer | 25 | 650, left col. | 872 |
| 9. Hardener | 26 | 651, left col. | 874–875 |
| 10. Binder | 26 | 651, left col. | 873–874 |
| 11. Plasticizer, Lubricant | 27 | 650, right col. | 876 |
| 12. Coating Aid, Surfactant | 26–27 | 650, right col. | 875–876 |
| 13. Antistatic Agent | 27 | 650, right col. | 876–877 |
| 14. Matting Agent | | | 878–879 |

EXAMPLES

The present invention will now be illustrated in detail without limiting the same.

Example 1

According to Example 1 described in Japanese Patent Laid-Open Publication No. 854/1990, page 20–24, a multilayer color photographic material was prepared on an undercoated cellulose triacetate film support of 127 $\mu$m in thickness to obtain Sample No. 101 for comparison, shown in Table 3. In this table, numerals represent addition amounts per $m^2$ and effects of added compounds are not limited to those described therein. "type" described therein means the standard value.

Samples Nos. 102 to 116 were prepared in an analogous manner to Sample No. 101 except changing the additive and addition amount of Second Protective Layer (15th layer) in those shown in Table 3. Second Protective Layer was formed by adjusting a gelatin coating amount to 1 g/m$^2$ so as to obtain a film thickness of 0.8 $\mu$m on dry basis.

TABLE 3

| Sample No. | 15th Layer: Second Protective Layer Additives | Addition Amount (g/m$^2$) | Number of Adhered Frames | Surface Lustre | Haze | Graininess | Film Brittleness |
|---|---|---|---|---|---|---|---|
| 101* | — | — | 36 | 100 | 100 | type | type |
| 102* | PMA added | 0.1 | 1 | 85 | 145 | bad | bad |
| 103* | Q-1 | 0.2 | 28 | 91 | 108 | equal | little bad |
| 104* | Q-2 | 0.2 | 17 | 99 | 101 | equal | equal |
| 105* | Q-3 | 0.2 | 20 | 99 | 101 | equal | equal |
| 106* | Q-4 | 0.2 | 28 | 91 | 108 | equal | little bad |
| 107* | Q-5 | 0.2 | 1 | 90 | 120 | little bad | little bad |
| 108* | Q-6 | 0.2 | 30 | 99 | 101 | equal | equal |
| 109 | P-1 | 0.2 | 1 | 99 | 101 | equal | equal |
| 110 | P-2 | 0.2 | 1 | 99 | 101 | equal | equal |
| 111 | P-3 | 0.2 | 1 | 99 | 102 | equal | equal |
| 112 | P-4 | 0.2 | 1 | 98 | 102 | equal | equal |
| 113 | P-5 | 0.2 | 2 | 98 | 101 | equal | equal |
| 114 | P-6 | 0.2 | 2 | 98 | 102 | equal | equal |
| 115 | P-1 | 0.3 | 0 | 98 | 102 | equal | equal |
| 116 | P-1 | 0.4 | 0 | 97 | 102 | equal | equal |

(Note)
Sample No. 102: polymethylmethacrylate further added, mean grain diameter: 1.5 $\mu$m
Sample Nos. 101–108*: comparative examples
Sample Nos. 109–116: present invention These samples were subjected to exposure and developed, and then subjected to estimation of the antiblocking property, surface lustre, haze, graininess and film brittleness, thus obtaining results shown in Table 3. The estimation of the antiblocking property is represented by allowing the sample to stand under an atmosphere at 30° C. and 90% RH in a transparent sleeve for 20 days and counting the number of adhered frames (the smaller, the better), in which adhered traces can be seen as appearing on image areas, the total number of the frames being 36. The surface lustre is represented by a reflection factor at 60 degrees, as a relative value based on 100 of Sample No. 101 for comparison (the larger, the better). The haze is measured by means of a haze meter to obtain a relative value based on 100 of Sample No. 101 for comparison (the smaller, the better). The graininess is obtained by comparing with Sample No. 101 for comparison regarding roughness of grains projected by a projector on a low concentration area. The film brittleness is estimated by cracks formed at −20° C. as a relative value based on 100 of Sample No. 101 for comparison.

As is evident from the results of Table 3, Sample No. 102 for comparison using a matting agent with a larger mean grain diameter is excellent in anti-blocking property, but is inferior in surface lustre, haze and graininess, and Sample Nos. 103 to 106 and 108 for comparison show insufficient improvement in antiblocking property. Sample No. 107 for comparison is excellent in anti-blocking property, but shows a bad result as to the surface lustre and haze. In contrast, Sample Nos. 109 to 116 according to the present invention give better results as to not only antiblocking property, but also haze, graininess and film brittleness.

Example 2

1) Support

A support used in this example was prepared by the following method.

100 parts by weight of commercially available polyethylene-2,6-naphthalate polymer and 2 parts by weight of Tinuvin P. 326 (commercial name, manufactured by Ciba-Geigy Co.) as a UV absorber were dried in conventional manner, melted at 300° C., extruded through a T-type die, subjected to longitudinal stretching of three times at 140° C. and then to lateral stretching of three times at 130° C. and further thermally fixed for 6 seconds at 250° C. to obtain a PEN film with a thickness of 90 $\mu$m.

A part of the film was wound round a stainless steel winding drum of 20 cm in diameter and subjected to thermal history at 110° C. for 48 hours.

2) Coating of Undercoated Layer

The above described support was subjected to a corona discharge treatment, UV discharge treatment, glow discharge treatment and flame treatment of both the surfaces thereof and onto each of the surfaces was coated an undercoating liquid having the following composition to provide a high temperature side during stretching with a subbing layer. The corona discharge treatment of a support of 30 cm in width was carried out at 20 m/min using a solid state corona discharge machine (6 KVA Model) manufactured by Pillar Co., during which the support was treated at 0.375 KV·A·min/m$^2$, based on reading values of current and voltage. During the treatment, the discharge frequency was 9.6 KHz and a gap clearance between an electrode and dielectric roll was adjusted to 1.6 mm. The UV discharge treatment was carried out with heating at 75° C. and the glow discharge treatment was carried out by irradiation using a circular electrode for 30 seconds at 3000 W.

| | |
|---|---|
| Gelatin | 3 g |
| Distilled Water | 25 ml |
| Sodium α-Sulfo-Di-2-Ethylhexyl Succinate | 0.05 g |
| Formaldehyde | 0.02 g |

-continued

| | |
|---|---|
| Salicylic Acid | 0.1 g |
| Diacetyl Cellulose | 0.5 g |
| p-Chlorophenol | 0.5 g |
| Resorcinol | 0.5 g |
| Cresol | 0.5 g |
| $(CH_2{=}CHSO_2CH_2CH_2NHCO)_2CH_2$ | 0.2 g |
| Aziridine Three Times Mol Adduct of Trimethylolpropane | 0.2 g |
| Toluene Diisocyanate Three Mol Adduct of Trimethylolpropane | 0.2 g |
| Methanol | 15 ml |
| Acetone | 85 ml |
| Formaldehyde | 0.01 g |
| Acetic Acid | 0.01 g |
| Conc. Hydrochloric Acid | 0.01 g |

3) Coating of Backing Layer

Onto one side of the above described support after undercoating were coated, as a backing layer, an antistatic layer, magnetic recording layer and sliding layer having the following compositions.

3-1) Coating of Antistatic Layer 3-1-1) Preparation of Dispersion of Electroconductive Fine Grains (Mixed Dispersion of Tin Oxide-Antimony Oxide)

230 parts by weight of stannic chloride hydrate and 23 parts by weight of antimony trichloride were dissolved in 3000 parts by weight of ethanol to prepare a uniform solution, to which an aqueous solution of 1 N sodium hydroxide was dropwise added until pH of the solution was 3 to obtain a coprecipitate of colloidal stannic oxide and antimony oxide. The resulting coprecipitate was allowed to stand at 50° C. for 24 hours to obtain a red and brown colloi dal precipitate.

The red and brown colloidal preipitate was separated by centrifuge. To remove the excessive ions, water was added to the precipitate to wash it with water by centrifuge. This procedure was repeated three times to remove the excessive ions. 200 parts by weight of the colloidal precipitate, from which the excessive ions had been removed, was dispersed again in 1500 parts by weight of water and sprayed in a calcining furnace heated at 650° C. to obtain a blueish fine grain powder of mixed tin oxide-antimony oxide having a mean grain diameter of 0.005 $\mu$m. The fine grain powder had a resistivity of 5 Ω·cm.

A mixture of 40 parts by weight of the above described fine grain powder and 60 parts by weight of water was controlled to have a pH of 7.0, roughly dispersed by a stirrer and then further dispersed for a residence time of 30 minutes by means of a horizontal type sand mill (commercial name, Dinomill, manufactured by WILLYA, BACHOFENAG). During the same time, the secondary aggregate had a mean grain diameter of about 0.04 $\mu$m.

3-1-2) Coating of Conductive Layer

An electroconductive layer according to the following recipe was coated to give a film thickness of 0.2 $\mu$m on dry basis and dried at 115° C. for 60 seconds.

| Electroconductive Fine Grain Dispersion | |
|---|---|
| Prepared in 3-1-1) | 20 parts by weight |
| Gelatin | 2 parts by weight |
| Water | 27 parts by weight |
| Methanol | 60 parts by weight |
| p-Chlorophenol | 0.5 parts by weight |

-continued

| Electroconductive Fine Grain Dispersion | |
|---|---|
| Resorcinol | 2 parts by weight |
| Polyoxyethylene Nonyl Phenyl Ether | 0.01 parts by weight |

The resulting electroconductive film had excellent antistatic property as represented by a resistance of $10^{8.0}$ (100 V).

3-2) Coating of Magnetic Recording Layer 1100 g of a magnetic substance Co-coated $\gamma$-$Fe_2O_3$ (needle-shaped crystal with a long axis of 0.14 $\mu$m and short axis of 0.03 $\mu$m, specific surface area of 41 $m^2$/g, saturation magnetization of 89 emu/g, coercive force of 930 Oe, $Fe^{+2}/Fe^{+3}$ ratio of 6/94 and surface-treated with 2 weight % of aluminum oxide and silicon oxide, respectively based on $Fe_2O_3$, was mixed with 220 g of water and 150 g of a silane coupling agent consisting of polyoxyethylene (polymerization degree: 16) propyltrimethoxysilane and adequately kneaded by an open kneader for 3 hours. The thus roughly dispersed viscous liquid was dried at 70° C. one day and night to remove the water content and heated at 110° C. for 1 hour to prepare surface-treated magnetic grains.

Furthermore, a composition having the following recipe was again kneaded by an open kneader.

| Above Described Surface-Treated Magnetic | |
|---|---|
| Grains | 1000 g |
| Diacetyl Cellulose | 17 g |
| Methyl Ethyl Ketone | 100 g |
| Cyclohexanone | 100 g |

This composition was further finely dispersed for 4 hours by a sand mill (¼ G) at 200 rpm according to the following recipe.

| | |
|---|---|
| Above Described Kneaded Product | 100 g |
| Diacetyl Cellulose | 60 g |
| Methyl Ethyl Ketone | 300 g |
| Cyclohexanone | 300 g |

Diacetyl cellulose as a binder and toluene diisocyanate three mol adduct of tri methylolpropane as a hardener in a proportion of 20 weight % to the binder were further added. The resulting liquid mixture was diluted with methyl ethyl ketone and cyclohexanone in equal amounts to give a viscosity of about 80 CP. Coating thereof was carried out on the above described electroconductive layer by the use of a bar coater to obtain a film thickness of 1.2 $\mu$m and a magnetic substance amount of 62 mg/$m^2$. In addition, silica grains (0.3 $\mu$m) as a matting agent and aluminum oxide grains (0.5 $\mu$m) as an abrasives were respectively added to give a coating amount of 10 mg/$m^2$. Drying was then carried out at 115° C. for 6 minutes (rollers and transporting means in a drying zone being all maintained at 115° C.).

An increment of the color density of $D^B$ in the magnetic recording layer, when using a blue filter in Status M of X-light, was about 0.1, and the magnetic recording layer had a saturation magnetization moment of 4.2 emu/$m^2$, coercive force of 923 Oe and squareness ratio of 65%.

3-3) Preparation of Sliding Layer

A liquid composition comprising the following compounds was coated to provide the following solid coating amount of the compounds and dried at 110° C. for 5 minutes to obtain a sliding layer:

| | |
|---|---|
| Diacetyl Cellulose | 25 mg/m$^2$ |
| $C_6H_{13}CH(OH)C_{10}H_{20}COOC_{40}H_{81}$ (Compound a) | 6 mg/m$^2$ |
| $C_{50}H_{101}O(CH_2CH_2O)_{16}H$ (Compound b) | 9 mg/m$^2$ |

In this procedure, a mixture of Compound a/Compound b (6:9) was heated and dissolved in a solvent of xylene and propylene glycol monomethyl ether (volume ratio: 1:1) at 105° C. and the liquid was poured in propylene glycol monomethyl ether (25° C.) of ten times as much as the liquid to prepare a fine dispersion, which was further diluted with acetone in an amount of five times and dispersed again by a high pressure homogenizer (200 atm) to obtain a dispersion (mean grain diameter: 0.01 μm), followed by the coating.

The thus obtained sliding layer exhibited excellent properties, i.e. a kinematic friction coefficient of 0.06 (stainless steel hard ball of 5 mm in diameter, load 100 g, speed 6 cm/min) and static friction coefficient (Clip method) of 0.07. The sliding property with an emulsion surface, illustrated below, was represented by a kinematic friction coefficient of 0.12.

4) Coating of Sensitive Layer

Onto the opposite side of the backing layer, obtained as described above, was then coated the same photographic material as that of Example 1.

The thus prepared photographic material was cut in a size of 24 mm width and 160 cm length, in the longitudinal direction of which two perforations of 2 mm square were made at a position of 0.7 mm from one side in the width direction and at an interval of 5.8 mm and two sets of them were provided at an interval of 32 mm, and then charged in a film cartridge of plastics, illustrated in FIG. 1 to FIG. 7 in U.S. Pat. No. 5,296,887.

These samples were subjected to exposure and development, and then to the similar estimation to Example 1 except changing the estimation of the anti-blocking property to be carried out in the form of a cartridge, thus obtaining similar results to those of Example 1.

Advantages of Present Invention

When the polymer grains specified according to the present invention is used, the antiblocking property of a photographic material can be improved with out deteriorating the film brittleness and image quality.

What is claimed is:

1. A silver halide photographic material having at least one silver halide emulsion layer and at least one nonsensitive protective layer on a support, in which the nonsensitive protective layer contains polymer grains represented by the following General Formula (1) in a proportion by weight of 5 to 300% to a hydrophilic colloid as a binder, and the polymer grains have a mean grain diameter of at most 0.1 μm, and a glass transition temperature of at least 70° C., $$—(A)_x—(B)_y—(C)_z— \qquad \text{General Formula (1)}$$

wherein A is a repeated unit derived from an ethylenically unsaturated monomer containing carboxyl group, B is a repeated unit derived from a cross-linking monomer having at least two ethylenically unsaturated groups and C is a repeated unit derived from another ethylenically unsaturated monomer than those of A and B, x, y and z are copolymerization ratios, x being 15 to 50 weight %, y being 3 to 15 weight % and z being 30 to 85 weight %, and x+y+z=100.

2. The silver halide photographic material as claimed in claim 1, wherein the polymer grains have a mean grain diameter of 0.01 μm to 0.08 μm.

3. The silver halide photographic material as claimed in claim 1, wherein wherein the polymer grains have a mean grain diameter of 0.005 μm to 0.05 μm.

4. The silver halide color photographic material as claimed in claim 1, wherein the silver halide photographic material is a color photographic material.

5. The silver halide color photographic material as claimed in claim 1, wherein the photographic material is in the form of a roll wrapped in a spool with an outer diameter of 5 to 11 mm.

6. The silver halide color photographic material as claimed in claim 1, wherein the nonsensitive protective layer is provided, relative to the support, above the silver halide emulsion layer and contains non-soluble matting agent grains with a grain size of at least 2 μm in a proportion of at most 0.008 g/m$^2$.

7. The silver halide color photographic material as claimed in claim 6, wherein the non-soluble matting agent is at least one member selected from the group consisting of polymethylmethacrylate, polystyrene, acrylic acid-methylmethacrylate copolymers, methacrylic acid-methylmethacrylate copolymers.

8. The silver halide photographic material as claimed in claim 1, wherein the nonsensitive protective layer is the outermost layer of the silver halide photographic material.

* * * * *